US008310164B2

(12) United States Patent
Cheng et al.

(10) Patent No.: US 8,310,164 B2
(45) Date of Patent: Nov. 13, 2012

(54) MULTI-LAMP DRIVING SYSTEM

(75) Inventors: Chin-Po Cheng, Jhongli (TW); Yong-Long Lee, Jhongli (TW)

(73) Assignee: Ampower Technology Co., Ltd., Jhongi, Taoyuan County (TW)

( * ) Notice: Subject to any disclaimer, the term of this patent is extended or adjusted under 35 U.S.C. 154(b) by 440 days.

(21) Appl. No.: 12/772,925

(22) Filed: May 3, 2010

(65) Prior Publication Data

US 2011/0101865 A1 May 5, 2011

(30) Foreign Application Priority Data

Oct. 30, 2009 (CN) ..... 2009 1 0309157

(51) Int. Cl.
*H05B 39/00* (2006.01)

(52) U.S. Cl. ..... 315/177; 315/291; 315/254; 315/257; 315/276

(58) Field of Classification Search ..... 315/117, 315/291, 307, 312, 254, 255, 257, 276, 277, 315/278, 279, 282, 219, 220, 221
See application file for complete search history.

(56) References Cited

U.S. PATENT DOCUMENTS 5,428,267 A * 6/1995 Peil ..... 315/224
2009/0146577 A1* 6/2009 Yamasaki et al. ..... 315/257

* cited by examiner

*Primary Examiner* — Douglas W Owens
*Assistant Examiner* — Jianzi Chen
(74) *Attorney, Agent, or Firm* — Atlis Law Group, Inc.

(57) ABSTRACT

A multi-lamp driving system includes a power supply and at least one balance transformer. Each balance transformer includes two cores, two primary windings, two secondary windings and two protection windings. Each primary winding is wrapped around a core and serially connected to a lamp to form a first circuit branch in parallel connection with each other. The first circuit branches are powered by the power supply. The Each secondary winding is wrapped around a core and connected to a primary winding. The two secondary windings are connected in series to form a short circuit loop. Each of the protection windings is wrapped around a core and connected to a primary winding. The protection windings are wrapped in opposite directions and connected in series to form a second circuit branch. The second circuit branch outputs voltage signals to the power supply when induced voltages crossing the protection windings are unequal.

10 Claims, 2 Drawing Sheets

MULTI-LAMP DRIVING SYSTEM

BACKGROUND

1. Technical Field

The present disclosure relates to a driving system for driving cold cathode fluorescent lamps and, particularly to a multi-lamp driving system for driving a plurality of lamps.

2. Description of Related Art

With the further development of liquid crystal display (LCD) panels, are more and more LCD panels being used in backlight apparatuses with a plurality of cold cathode fluorescent lamps (CCFLs) as light sources.

One problem with a multi-lamp backlight apparatus is to how to maintain an even distribution of current among the lamps so that the light source provides a stable and uniform illumination to the LCD panel.

To solve the problem above-mentioned problem, one method is have a balance circuit that includes a balance transformer. The balance transformer uses a common alternating current source to drive the multiple lamps in parallel connection. The balance circuit includes a plurality of outputs for driving corresponding lamps. If the current of one of the lamps becomes zero, there might be an over-voltage generated on the other lamps. However, the present balance circuits have no detection circuit to detect this abnormal condition.

What is needed, therefore, is a multi-lamp driving system to overcome the above-described problem.

BRIEF DESCRIPTION OF THE DRAWINGS

Many aspects of the present multi-lamp driving system can be better understood with reference to the following drawings. The components in the drawings are not necessarily drawn to scale, the emphasis instead being placed upon clearly illustrating the principles of the present multi-lamp driving system.

DETAILED DESCRIPTION

Embodiments of the present disclosure will now be described in detail below, with reference to the accompanying drawings.

Figure 1:
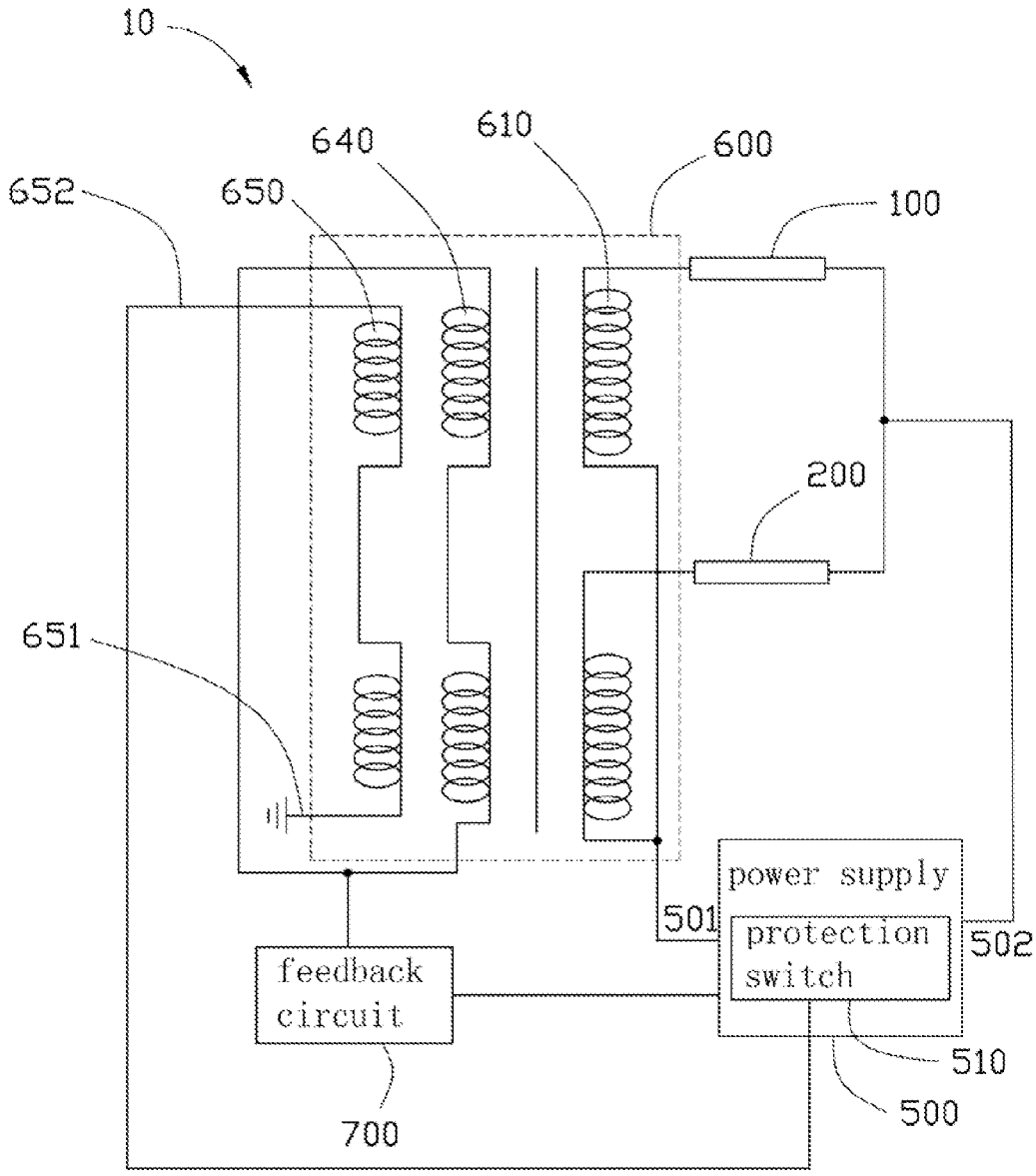
FIG. 1 is an equivalent circuit of a multi-lamp driving system according to an exemplary embodiment.

Referring to FIG. 1, a multi-lamp driving system 10 for driving a first lamp 100, and a second lamp 200 in parallel connection with the first lamp 100, according to an exemplary embodiment, is shown. The first lamp 100 and the second lamp 200 are cold cathode fluorescent lamps. The multi-lamp driving system 10 includes a power supply 500, a balance transformer 600, and a feedback circuit 700. The first lamp 100 and the second lamp 200 are electrically connected to the power supply 500 via the balance transformer 600. The feedback circuit 700 is electrically connected between the power supply 500 and the balance transformer 600 and is configured for monitoring the current flowing through the balance transformer 600, and to send a feedback signal to the power supply 500 according to the monitoring. The power supply 500 includes a first output terminal 501 and a second output terminal 502.

Figure 2:
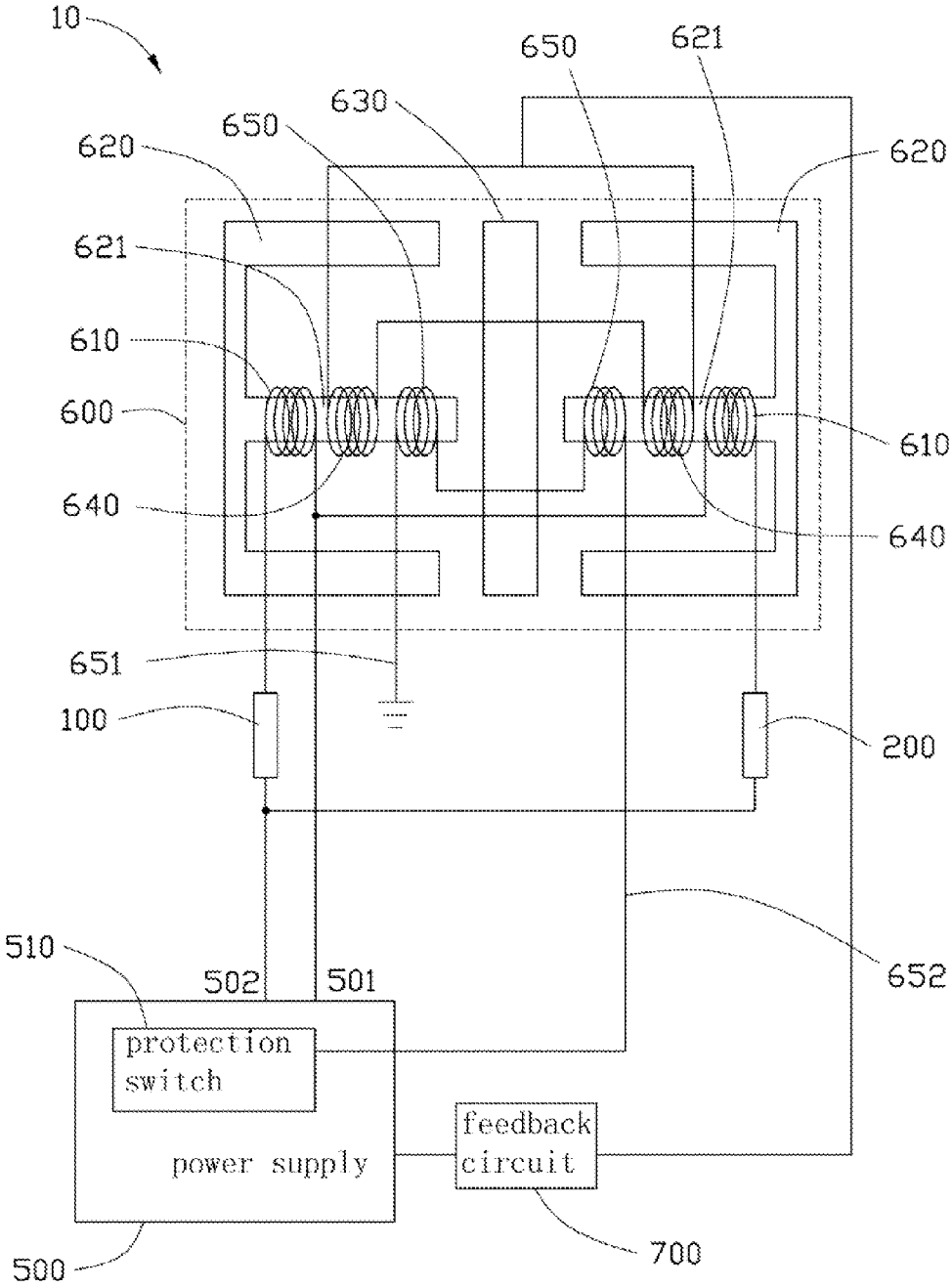
FIG. 2 is a schematic view of the multi-lamp driving system of FIG. 1.

Referring to FIGS. 1 and 2, the balance transformer 600 includes two primary windings 610, two E-shape cores 620, an I-shape core 630, two secondary windings 640, and two protection windings 650.

The E-shape cores 620 are positioned face to face and the I-shape core 630 are positioned between the two E-shape cores 620. Each E-shape core 620 includes three segments 621 connected in parallel. The primary windings 610 are wrapped around the center segments 621 of the E-shape cores 620 correspondingly. One of the primary windings 610 is connected in series with the first lamp 100 to form a first circuit branch, and the other of the primary windings 610 is connected in series with the second lamp 200 to form a second circuit branch connected in parallel with the first circuit branch. The first circuit branch and the second circuit branch both are coupled between the first output terminal 501 and the second output terminal 502 of the power supply 500.

The secondary windings 640 are wrapped around the center segment 621 of the E-shape cores 620 and electromagnetically coupled to the primary windings 610 correspondingly. The secondary windings 640 are connected to each other to form a short circuit loop. The short circuit loop is connected to the feedback circuit 700. The two secondary windings 640 are connected in series to form a loop, the current induced in the two secondary windings 640 are the same, which causes the current to evenly distribute among the two primary windings 610 even though a resistance deviation may exist among the first circuit branch and the second circuit branch.

Current flowing through the secondary windings 640 is proportional to current flowing through the primary windings 610, because the secondary windings 640 are electromagnetically coupled to the primary windings 610 correspondingly. The feedback circuit 700 calculates the current flowing through the primary windings 610 according to the current flowing through the secondary windings 640. The feedback circuit 700 sends the feedback signal to the power supply 500 according to the current flowing through the primary windings 610. The power supply 500 supplies an appropriate electrical energy to the first lamp 100 and the second lamp 200 based on the feedback signal from the feedback circuit 700.

The two protection windings 650 are wrapped around the center segment 621 of the two E-shape cores 620 correspondingly, adjacent to the corresponding secondary winding 640. Each of the secondary windings 640 is disposed between the corresponding primary winding 610 and the corresponding protection winding 650. The protection windings 650 are wrapped in opposite directions, which results in the current induced in the protection windings 650 having opposite polarities. The protection windings 650 are connected in series to form a circuit branch. The circuit branch includes a first end 651 and a second end 652. The first end 651 is grounded, and the second end 652 is electrically coupled to the power supply 500.

When both the first lamp 100 and the second lamp 200 work normally, the current flowing through the two primary windings 610 is the same, and the current flowing through the two secondary windings 640 is the same, thereby the magnetic field around the two center segments 621 is the same. The voltages induced across the protection windings 650 are equal, but with opposite polarities. The second end 652 transmits no voltage signal to the power supply 500. If either of the first lamp 100 and the second lamp 200 is opened or shorted, the voltages crossing the two protection windings 650 are unequal, and the second end 652 transmits voltage signals to the power supply 500. The voltage signals output to the power supply 500 indicate an abnormality in the lamps 100 and 200 has occurred.

The power supply 500 is an alternating current power supply. The power supply 500 includes a protection switch 510. The protection switch 510 is electrically coupled to the second end 652. The protection switch 510 turns off the power supply 500 to protect the lamps 100 and 200 according to the voltage signals received from the second end 652.

While certain embodiments have been described and exemplified above, various other embodiments will be apparent to those skilled in the art from the foregoing disclosure. The present disclosure is not limited to the particular embodiments described and exemplified, and the embodiments are capable of considerable variation and modification without departure from the scope of the appended claims.

What is claimed is:

1. A multi-lamp driving system, comprising:

a power supply;

at least one balance transformer comprising:

two cores;

two primary windings, each of the primary winding wrapped around a corresponding core and serially connected to a lamp to form a first circuit branch in parallel connection with each other, the first circuit branches being powered by the power supply;

two secondary windings, each of the secondary windings wrapped around a corresponding core and electromagnetically coupled to a corresponding primary winding of the balance transformer, two secondary windings of the balance transformer connected in series to form a short circuit loop;

two protection windings, each of the protection windings wrapped around a corresponding core of the balance transformer and electromagnetically coupled to a corresponding primary winding of the balance transformer, the protection windings wrapped in opposite directions and connected in series to form a second circuit branch, the second circuit branch configured for outputting voltage signals to the power supply when induced voltages crossing the protection windings are unequal.

2. The multi-lamp driving system as claimed in claim 1, wherein each of the protection windings of the balance transformer is adjacent to the corresponding one of the secondary windings of the balance transformer.

3. The multi-lamp driving system as claimed in claim 1, wherein the power supply comprise a protection switch electrically coupled to the second circuit branch, and the protection switch is configured for switching off the power supply when receiving the voltage signals from the second circuit branch.

4. The multi-lamp driving system as claimed in claim 3, wherein the second circuit branch is electrically coupled between the protection switch and the ground.

5. The multi-lamp driving system as claimed in claim 1, wherein the multi-lamp driving system further comprises a feedback circuit electrically coupled to the short circuit loop, the feedback circuit is configured for monitoring current flowing through the secondary windings of the balance transformer, and sending feedback signals to the power supply accordingly, the power supply supplies a power according to the feedback signal.

6. The multi-lamp driving system as claimed in claim 1, wherein the cores of the balance transformer are E-shaped and the balance transformer further comprises an I-shape core, the E-shape cores are positioned face to face and the I-shape core are positioned between the E-shape cores, each of the E-shape cores comprise three segments parallel connected to each other, each of the primary windings of the balance transformer, each of the secondary windings of the balance transformer and each of the projection windings of the balance transformer are wounded on the center segment of the corresponding one of the E-shape cores.

7. The multi-lamp driving system as claimed in claim 1, wherein the coil numbers of the primary windings of the balance transformer are substantially equaled to each other, the coil numbers of the secondary windings of the balance transformer are substantially equaled to each other, and the coil numbers of the protection windings of the balance transformer are substantially equaled to each other.

8. The multi-lamp driving system as claimed in claim 1, wherein each of the secondary windings of the balance transformer is positioned between the corresponding one of the primary windings of the balance transformer and the corresponding one of the protection windings of the balance transformer.

9. The multi-lamp driving system as claimed in claim 1, wherein the multi-lamp driving system drives cold cathode fluorescent lamps.

10. The multi-lamp driving system as claimed in claim 1, wherein the power supply is an alternating current source.

* * * * *